US008152332B2

(12) United States Patent
Ryan

(10) Patent No.: US 8,152,332 B2
(45) Date of Patent: Apr. 10, 2012

(54) LED CYCLORAMA LIGHT

(75) Inventor: John T. Ryan, Riverdale, NY (US)

(73) Assignee: Altman Stage Lighting Co., Inc, Yonkers, NY (US)

( * ) Notice: Subject to any disclaimer, the term of this patent is extended or adjusted under 35 U.S.C. 154(b) by 786 days.

(21) Appl. No.: 12/267,173

(22) Filed: Nov. 7, 2008

(65) Prior Publication Data

US 2010/0118528 A1 May 13, 2010

(51) Int. Cl.
*F21V 1/00* (2006.01)

(52) U.S. Cl. ..... 362/235; 362/217.05; 362/217.1; 362/231; 362/297; 362/367; 362/249.02; 362/311.02

(58) Field of Classification Search ..... 362/217.01–217.02, 217.05, 217.1, 362/231, 234–235, 268, 296.01, 297, 311.04, 362/347, 367, 245, 249.02, 311.02
See application file for complete search history.

(56) References Cited

U.S. PATENT DOCUMENTS

| | | | | |
|---|---|---|---|---|
| 963,912 | A | 7/1910 | Lyhne | |
| 1,923,970 | A | 8/1933 | Dowling | |
| 3,358,133 | A | 12/1967 | Thoman | |
| 3,610,915 | A | 10/1971 | Moore | |
| 3,686,495 | A | 8/1972 | Medley | |
| 4,323,953 | A | 4/1982 | Hutchison | |
| 4,439,816 | A | 3/1984 | Litchfield | |
| 4,447,859 | A | 5/1984 | Raczynski | |
| 4,985,815 | A | 1/1991 | Endo | |
| 5,373,431 | A | 12/1994 | Hayman et al. | |
| 2004/0085770 | A1 * | 5/2004 | Tyler et al. | 362/297 |

* cited by examiner

*Primary Examiner* — Stephen F Husar
*Assistant Examiner* — Meghan Dunwiddie
(74) *Attorney, Agent, or Firm* — Lackenbach Siegel, LLP; Myron Greenspan

(57) ABSTRACT

A cyclorama light includes a generally enclosed housing forming an interior compartment having a normally horizontal housing axis and an open front defining a window generally arranged within a plane parallel to said axis. A reflector substantially covers the window and has an operative portion that has a substantially uniform cross-section along the housing axis. An LED light emitter array extends along a line substantially parallel to the housing axis, the reflector having a surface configuration and the LED array being arranged in relation to the reflector surface to provide a higher flux density directed toward a far end of a wall or surface to be illuminated and provide a lower flux density directed toward a direction of the near end of the surface to be illuminated, generating a transition flux density between the far and near ends of the surface to be illuminated. The LED array and/or the reflector have optical features for eliminating shadows in the projected light over the entire illuminated surface.

50 Claims, 8 Drawing Sheets

LED CYCLORAMA LIGHT

BACKGROUND OF THE INVENTION

1. Field of the Invention

The invention generally relates to luminaries, and more specifically to an LED cyclorama light.

2. Description of the Prior Art

Large curved curtains or screens as backgrounds for stage settings have been used for many years. Such curtains or screens are frequently referred to as cycloramas ("CYCs"). Frequently such cycloramas also include a series of large pictures, as of a landscape, placed on a wall of a circular room so as to appear in natural perspective to a spectator standing on the set in the center. However, in the field of lighting, to which this invention relates, a cyclorama or a "CYC" is a vertical surface used to form the background for a theatrical setting, usually made of heavy cloth drawn tight to achieve a smooth flat surface. With appropriate light projected on it, it usually represents the sky or suggests limitless space. Traditionally, cycloramas were horizontally curved but may now also be flat or vertically curved as well. Examples of cycloramas are discussed generally in U.S. Pat. Nos. 3,989,362; 4,123,152; 4,512,117; and 4,893,447.

While CYC lights have been known and have also been used for many years, they have had a number of disadvantages. In the past, CYC lights were difficult and inconvenient to work with in providing desired light distributions on a cyclorama. Aside from being bulky and heavy, known CYC lights have not always provided the desired light distributions or the necessary ranges to cover different cyclorama configurations. This was particularly true when the same CYC lights were used to provide lighting for both flat and curved screens. Prior CYC lights have also had some difficulty in adjusting for non-level surfaces when these lamps are mounted on a floor or a stage. Lighting personnel have been required to use numerous objects that they placed under the light to adjust the angles of the light and the positions of shadow lines and/or to compensate for a non-level floor. The adjustments required were difficult and inconvenient to make. U.S. Pat. No. 6,220,731 issued to Altman Stage Lighting Co., Inc. discloses an easily adjustable cyclorama light or CYC light, which is a luminaire that could be mounted at the top and/or the bottom of a cyclorama in order to light it in smooth, substantially uniform manner.

Also, because CYC lights tend to emit significant amounts of light over relatively large areas, the lamps used for these lights tend to get very hot, thus also heating the luminaire itself. Failure to adequately cool the bulbs has caused the lights themselves to become extremely hot as well as to cause the deterioration of gel color filters used therein, and even caused damage to the reflectors. Overheating of the lamp housings also presented danger of injury to the lighting staff as well as others in proximity to these lights.

Other disadvantages of prior CYC light included the inability of such lights to accommodate more than one size lamp or bulb. However, because there are a number of different lamp sizes, a standard lamp could not always be substituted and only the lamp for which the light was specifically designed could be used to replace a burned out lamp.

Additionally, CYC lights have traditionally utilized monochromatic light sources, such as incandescent bulbs, quartz or halogen bulbs. In order to achieve the desired lighting effects, such as the simulation of a blue sky or a different colored background, filters were typically used through which the light source transmitted the light. "Gel" filters were frequently used for this purpose. Changes in colors were difficult or inconvenient to achieve, requiring that filters be physically changed since the light output remained at a constant temperature from the monochromatic light sources. This did not promote the use of frequent or rapid changes in colors or effects or even variations or ongoing color changes. Additionally, because colored filters needed to be used to provide desired colored light, the number of colors that were achievable were necessarily limited to the number of the light filters that were available. These were normally a relatively small number of filters and obtainable colors.

SUMMARY OF THE INVENTION

Accordingly, there is an object of the present invention to provide a CYC light that does not have the disadvantages inherent in prior art CYC lights.

It is another object of the present invention to provide CYC light that is simple in construction and economical to the manufacturer.

It is still another object of the present invention to provide a CYC light that utilizes arrays of LEDs as the primary sources of light.

It is still another object of the invention to provide a CYC light as in the previous object in which the LED light arrays are formed as RGBA clusters of LEDs that are individually controllable to allow light to provided having desired color outputs without the need for colored filters.

It is a further object of the present invention to provide a CYC light that includes an optically efficient reflector that provides a desired, substantially uniform distribution over substantial set areas of cycloramas or surfaces over which the light is projected.

It is still a further object of the present invention to provide a CYC light as in the previous object that uses a bank of LED clusters resulting in less heat generation and providing greater reliability than by using other light sources.

It is yet a further object of the present invention to provide a CYC light of the type under discussion that utilizes LED clusters that render the CYC light more efficient and safer to personnel to use.

It is an additional object of the present invention to provide a CYC light that can be adapted to illuminate flat as well as curved screens.

It is an additional object of the present invention to provide a CYC light that can be easily and quickly converted between ground CYC and sky CYC applications, or any other applications requiring the desired projected light patterns or distributions on a large screen or surface.

It is also an object of the present invention to provide a CYC light that utilizes a reflector and banks of LED light emitted arrays that are enclosed by an optical lens whose optical characteristics or properties can be modified to provide a large variation of projected light patterns or distributions, the reflector and/or the lens being provided with random surface texture to scatter the light and reduce or eliminate shadows or sharp discontinuities in the projected light pattern.

In order to achieve the above objects, as well as others that become evident hereafter, a CYC light in accordance with the present invention comprises a generally enclosed housing forming an interior compartment having a normally horizontal housing axis and an open front defining a window generally arranged within a plane parallel to said housing axis. A reflector substantially covers said window and has an operative portion that has a substantial uniform cross-section along said housing axis. An LED light emitter array extends along a line substantially parallel to said housing axis, the reflector having a surface configuration and said LED emitter array being arranged in relation to said reflector surface to provide a higher flux density directed toward a far end of a wall or surface to be illuminated and provide a lower flux density directed toward a near end of the surface to be illuminated in relation to the position of the CYC light, and providing a transitional flux density between the far and near ends of the surface to be illuminated. Means are advantageously provided for eliminating shadows in the projected light over the entire illuminated surface.

In accordance with a feature of the invention, the optical lens is positioned between the LED array and the reflector, said LED array and said lens together forming a generally symmetrical light flux source having a central primary axis and two secondary optical axes each angularly offset from the primary optical axis. Said flux light source is arranged in relation to said operative portion of the reflector to reflect light from the light flux source a higher flux density directed toward a far or remote end of the surface to be illuminated and reflect light from said light flux source a lower flux density directed toward the near or proximate end of the surface to be illuminated, a transition flux density being projected between said far and near ends of the surface.

BRIEF DESCRIPTION OF THE DRAWINGS

With the above additional objects and advantages in view, as will hereinafter appear, this invention comprises the devices, combinations and arrangements of parts hereinafter described by way of example, and illustrated in the accompanying drawings of presently preferred embodiments, in which.

DESCRIPTION OF THE PREFERRED EMBODIMENTS

Figure 1:
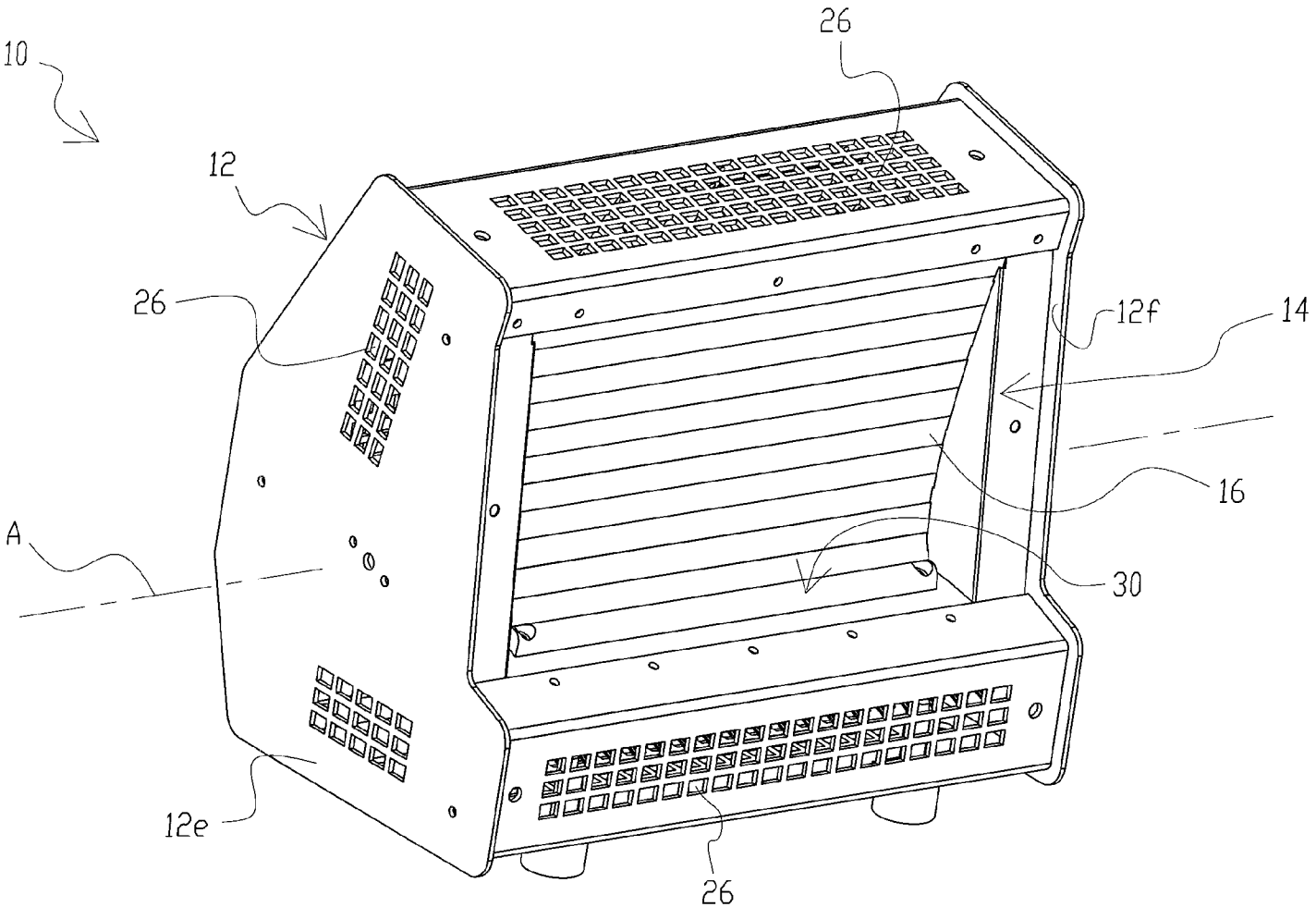
FIG. 1 is a perspective view of an LED Cyclorama Light in accordance with the present invention.

Referring now specifically to the figures, in which identical or similar parts are designated by the same reference numerals throughout, and first referring to FIGS. 1-4, a cyclorama light in accordance with the present invention is generally designated by the reference 10.

The cyclorama light 10 includes a generally enclosed housing 12 having a bottom wall 12*a*, a rear wall 12*b*, a top wall 12*c*, a front wall 12*d* and opposing side walls 12*e-f* as shown. The walls of the housing 12 form an interior compartment 17 and a housing axis A that generally extends along the longitudinal length of the housing. The top and bottom and side walls together form an open front defining a window 14 generally arranged within a plane parallel to the housing axis A.

A reflector 16 substantially covers the open window 14 as best as shown in FIG. 1. In the illustrated embodiment 10, normal panels 18, and the ends of the operative portion of the reflector 16 or end panels 20 essentially close the front of the housing, the panels 18, 20 being separate panels or may form part of the reflector 16 and, therefore, be integrally formed therewith or secured to the operative portion of the reflector in any suitable or known manner.

Figure 2:
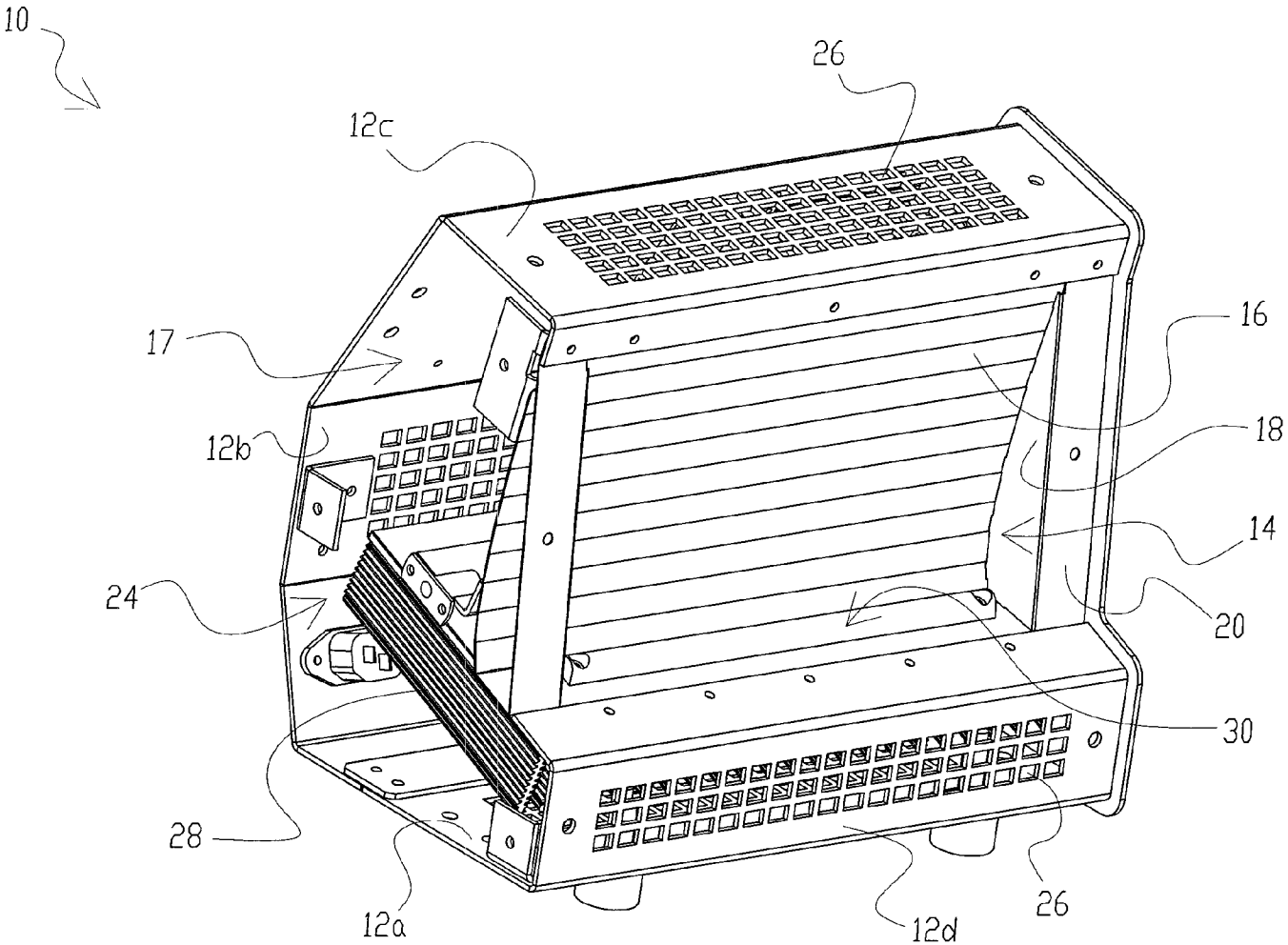
FIG. 2 is similar to FIG. 1, but shown with an end wall removed to illustrate the internal compartment of the unit in which operative elements or components are housed for controlling the CYC light and controlling the color and intensity of the light output therefrom.
Figure 3:
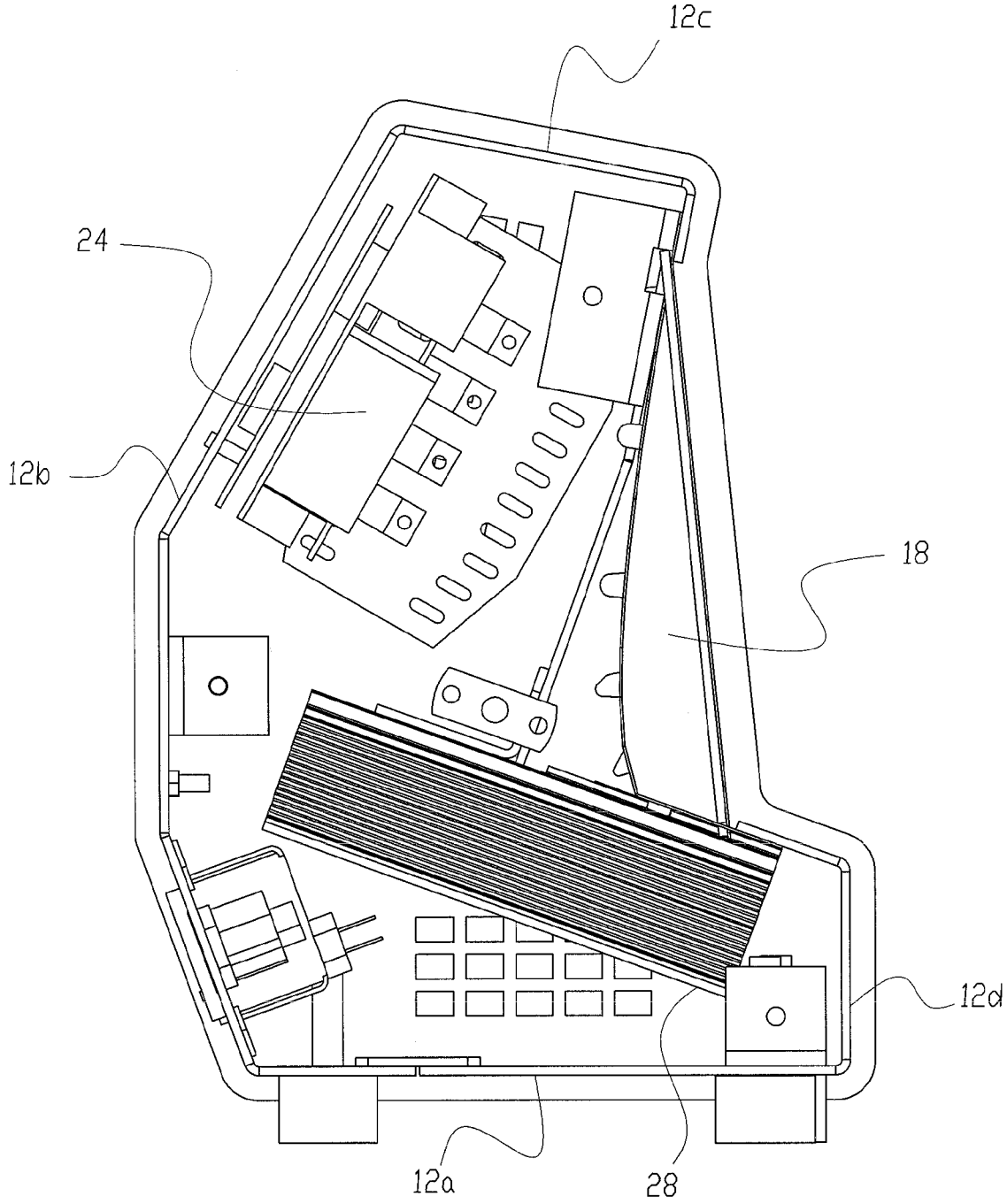
FIG. 3 is a side elevational view of the CYC light shown in FIG. 2, showing some additional details of the internal control elements or components.

Referring to FIGS. 2 and 3, control components or elements 24 are contained within the compartment 17 for introducing power and electrical control signals to the CYC light 10, as is well known to those skilled in the art. Ventilational openings 26 are advantageously provided in each of the walls of the housing 12 to allow heat to dissipate from the unit by convection, and heat sink 28 is provide to allow heat to dissipate from the unit by radiation and convection.

Figure 4:
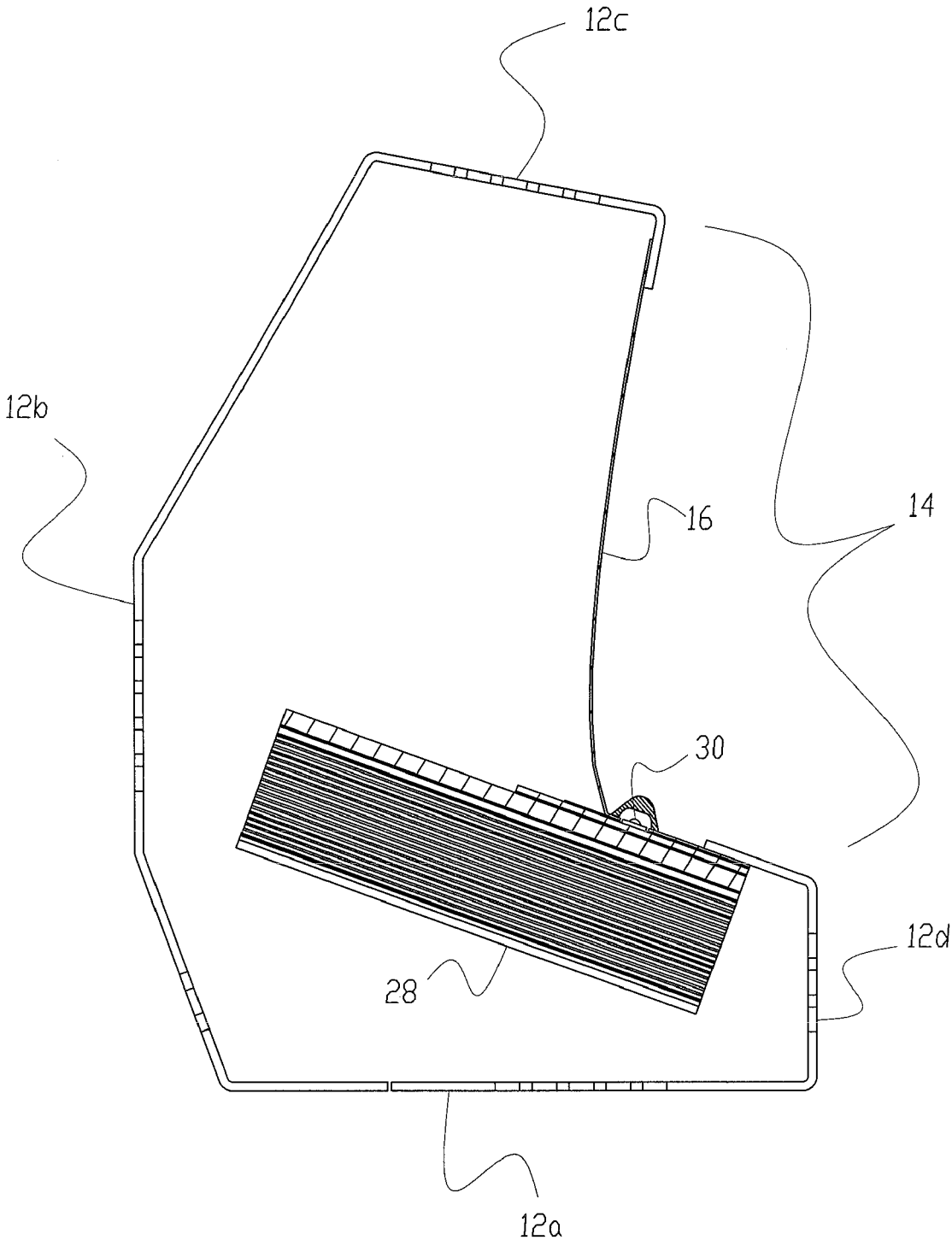
FIG. 4 is side elevational view similar to FIG. 3, but viewed from the other side of the unit but without most of the internal elements or components, showing the manner in which an LED light source is mounted in relation to the CYC light housing and reflector and as mounted on a heat sink.
Figure 8:
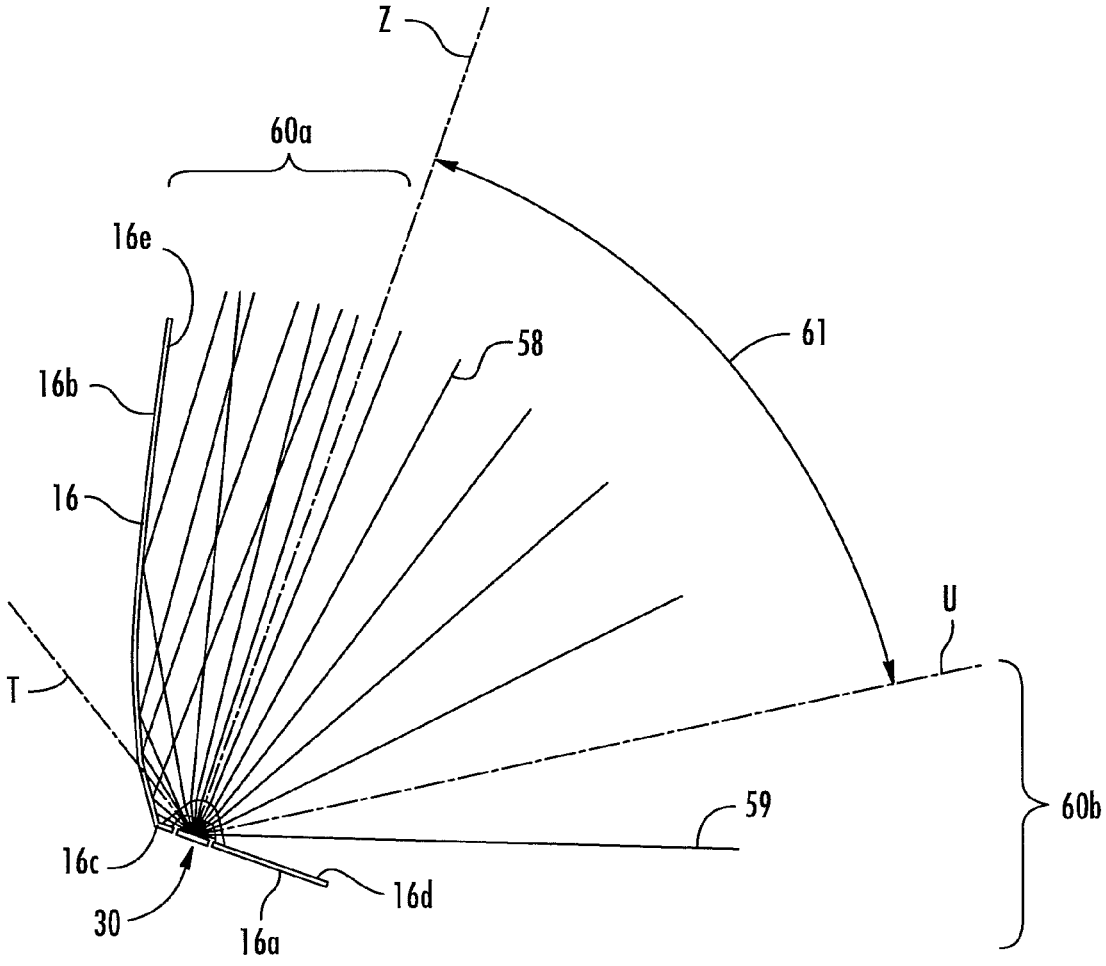
FIG. 8 is a diagrammatic representation of the LED light flux source in cooperation with the reflector, to provide a desired light flux distribution about the longitudinal axis of the LED light source.

The reflector 16, and more specifically the operative portion thereof between the panels 18, has a substantially uniform cross section along the housing axis A, as best as shown in FIGS. 3, 4 and 8. Referring to FIG. 8, the reflector has a generally downwardly extending flat elongated portion 16*a*, and a generally upwardly extending arcuate planar portion 16*b*, the planar portions being joined along a crease line 16*c*. Although the planar portion 16*a* is generally shown to be flat and the arcuate portion 16*b* is shown to have a generally parabolic shallow concave configuration, on the side of the reflector on which the light source is positioned, it will be evident to those skilled in the art that the reflector, or any of its planar portions can be modified or re-oriented to suit specific applications, with different degrees of advantage.

Figure 6:
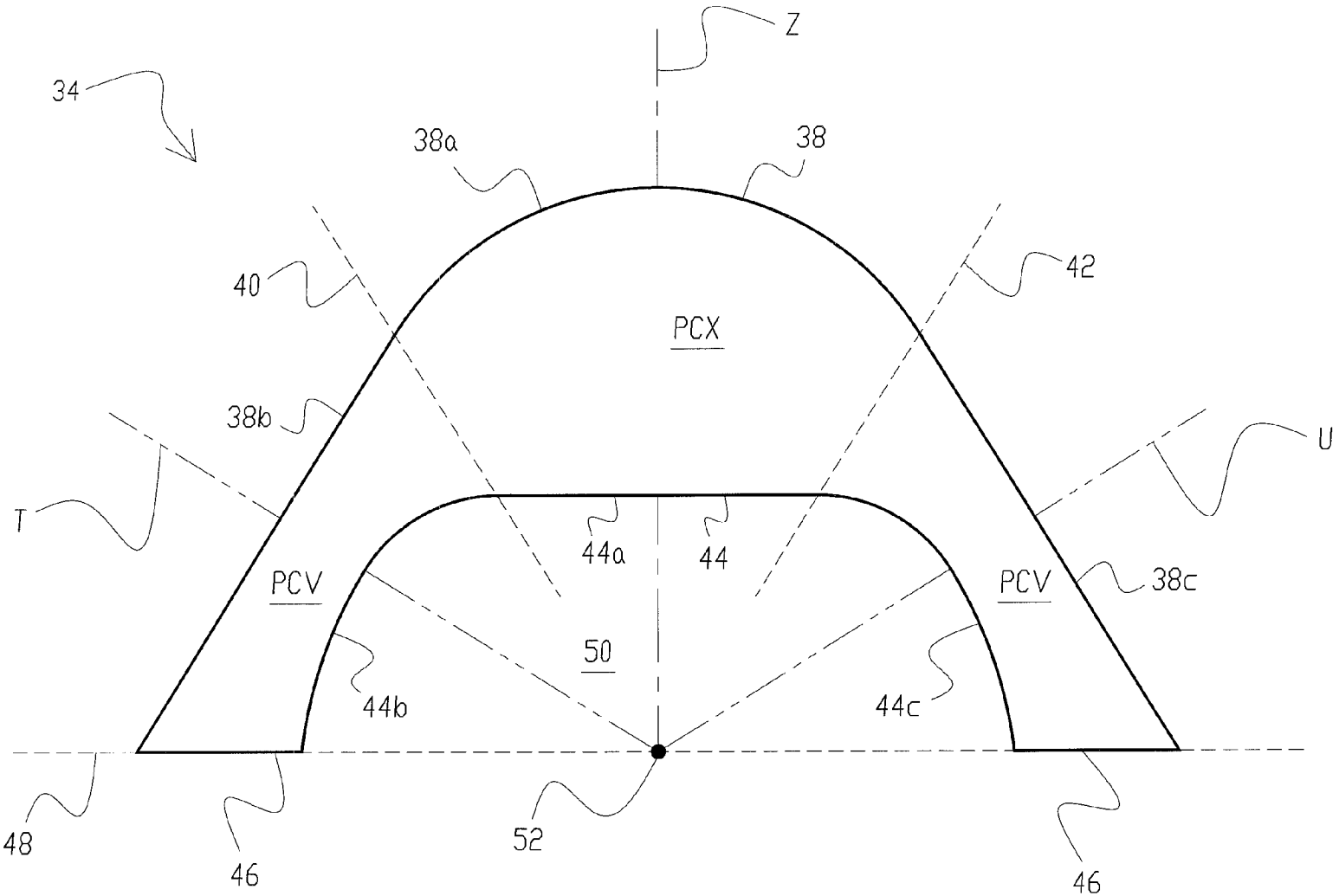
FIG. 6 is an enlarged end section of a lens of the type shown in FIG. 5, illustrating the interior and exterior surface profiles providing integrated plano-convex and plano-concave lens portions.

Preferably, the surfaces 16*d* and 16*e* of reflector's operative portion facing the light source are provided with a pseudo-random texture to help diffuse or scatter reflected light as a second order of effect, while reflecting the light primarily in accordance with the laws of reflection. Referring to FIGS. 6 and 8, the lens 34 is also preferably randomly textured on at least one of the interior surface 44 and/or the exterior surface 38 facing the reflector. The random textures on both the reflector surface or surfaces, and/or the lens are instrumental to break up the light and diffuse it in a manner to eliminate shadows or sharp discontinuities in the projected light over the entire illuminated surface. The reflector may be made of any suitable reflective material. Aluminum is a presently preferred material, as it provides the desired reflectivity, is a reasonably good conductor of heat, and is sufficiently malleable so that it can be formed or configured into any desired configuration or shape. One example of an aluminum material that can be used is Alanod 9040GP.

Figure 5:
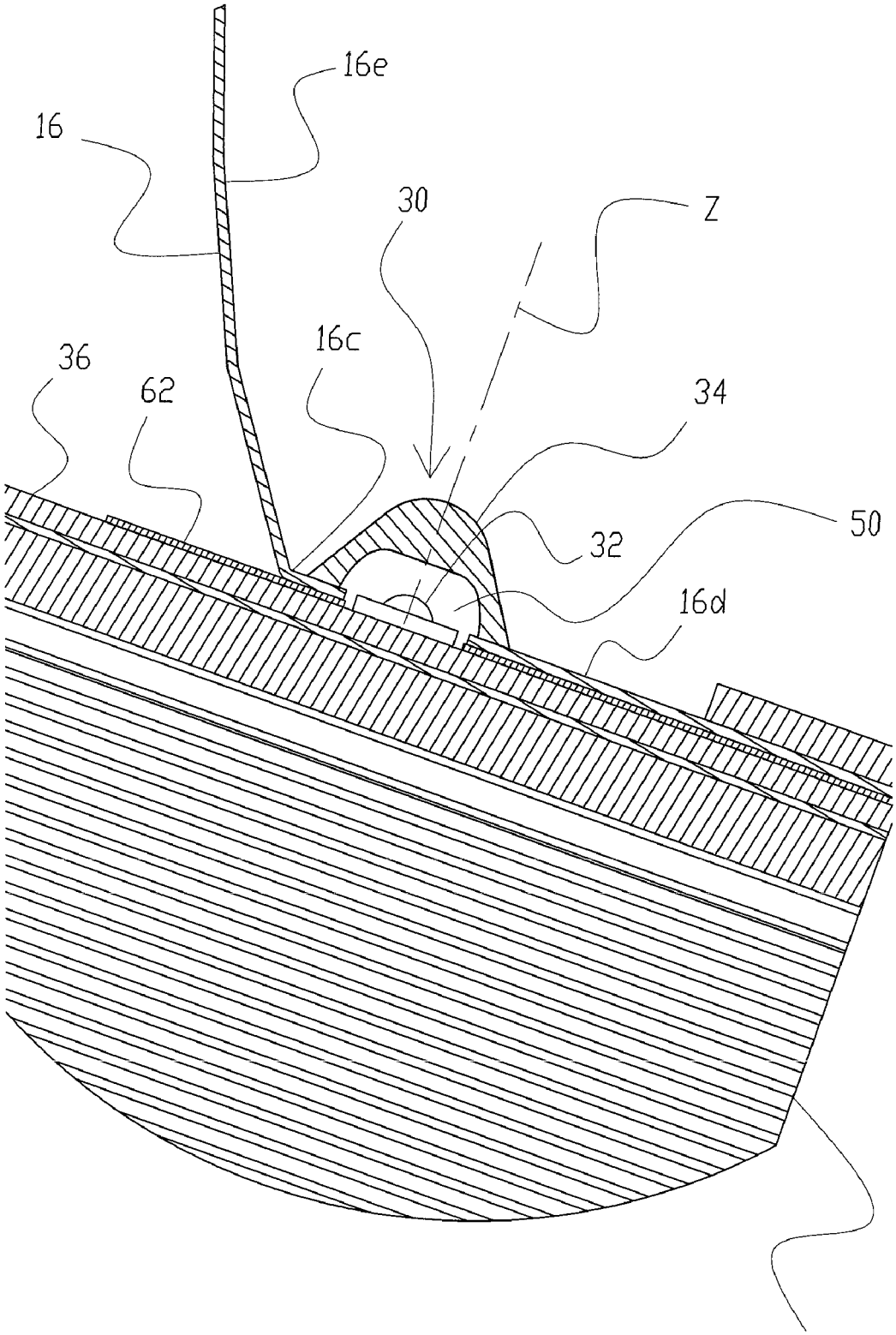
FIG. 5 is an enlarged detail of the region A shown in FIG. 4, illustrating additional details of the manner that the LED light source, including the LED light array or LED clusters are mounted on and cooperate with an optical lens that covers or encloses the LEDs.

An elongate light flux source 30 is provided at the lower region of the open window 14, as shown in FIG. 1, with the light source extending along a direction generally parallel to the housing axis A. Referring to FIGS. 5 and 8, the light source 30 is optically aligned with the planar portion of the reflector 16*d*.

The light source 30 includes a series or a plurality of LED's generally aligned with and spaced from each other and aligned along the length direction of the light source 30 and includes a lens 34 that substantially covers or encloses the LEDs 32. Thus, the LED emitter array extends along a line substantially parallel to the housing axis A, as does the elongate lens 34.

The LEDs that form the LED array 32 are preferably high-powered Red, Green, Blue, and Amber (RGBA) LED arrays or clusters. While the present invention may also be used with monochromatic LEDs that emit white light or any other combination of monochromatic light colors, the maximum benefits of the invention can be achieved by utilizing RGBA clusters of LEDs that can be suitably controlled or adjusted with local electrical control signals, and/or remote control protocols such as DMX or RDM, or wireless methods to control the intensity of the individual colors to thereby generate any desired color from an almost infinite number of colors, in any desired intensity thereof. These colors can be instantaneously modified either manually or by suitable control means, in a manner well known to those skilled in the art. The LED light source 30 may use, as suggested, any suitable high intensity LEDs. In the presently preferred embodiment, such LEDs are LUXEON REBEL™ LEDs manufactured by Philips Lumileds Lighting Company, a division of Philips. LUXEON is the trademark for high power LEDs that dissipate at least one watt or more. An entire line of LUXEON LEDs are available that produce powerful light and are used where high intensity light is desired. LUXEON REBEL LEDs are available in many colors, including white, and may be arranged in the form of RGBA clusters that may be spaced or staggered along the length of the lens 34. The clusters are arranged in close proximity to each other in a linear array.

The lens 34 is positioned between the LED clusters 32 and the reflector 16, as best shown in FIGS. 4, 5, 7 and 8. The lens 34 is in close proximity and encloses the LED clusters. The lens 34 preferably surrounds the LED array for at least 90° from an optical axis Z of an LED array, as best as shown in FIG. 5. While the material from which the lens is made is not critical, it is preferably made of a clear plastic material, such as a polycarbonate. Once specific example of a suitable plastic material is LEXAN® 945A.

Like the reflector 16, the lens 34 is also preferably provided with a uniform cross-section along its length along its own axis and the axis A. The cross-section may be in the form of a symmetrical deep meniscus or an asymmetrical deep meniscus. Similarly, the lens may have a substantially uniform symmetrical cross-section along its axis or an asymmetrical cross-section along that axis.

In the illustrated presently preferred embodiment, the lens has both planar and curved surfaces along at least one of the exterior and/or interior surfaces of the lens. Such curved surfaces may include convex or concave surfaces.

Referring to FIG. 6, a cross-sectional view is shown of one configuration of a lens in accordance with the invention. The lens 34 includes an exterior surface 38 that is separated into three regions by angularly offset separation lines 40, 42. Between the lines 40 and 42 there is provided a curved surface 38*a*. Below the separation line 40, to the lower most surface 46, there is provided a flat surface 38*b*. Similarly, between the separation line 42 and the lowermost support surface 46 there is provided a flat surface 38*c*. Similarly, the lens is provided with an internal surface 44 between the separation lines 40 and 42 provided with a generally flat surface 44*a*, while curved surfaces 44*b*, 44*c* extend between the flat surface 44*a* and the support surfaces 46. The support surfaces 46 are preferably flat and arranged in a common plane so that they are suitable for being positioned on a support surface or plane 48, such as a portion of the reflector 16*d*, as shown in FIG. 5. The reflector rests on the insulating pad 62, which in turn rests on the PCB assembly 36. This creates an internal channel 50 within the lens, dimensioned to receive the LEDs that are optically aligned with support plane 48, and together optically define a point source of light along a line 52, as shown in FIG. 5, 6. With the lens as shown in FIG. 6, there are effectively formed a plurality of lenses, a plano-convex lens being formed between the separation lines 40 and 42, while plano-concave lenses are effectively formed between the separation lines 40 and 42 and the support surfaces 46. As such, light that is directed through the plano-convex region PCX is caused to generally converge into a more focused beam, while light transmitted through the plano-concave regions PCV tends to diverge and be dispersed.

Figure 7:
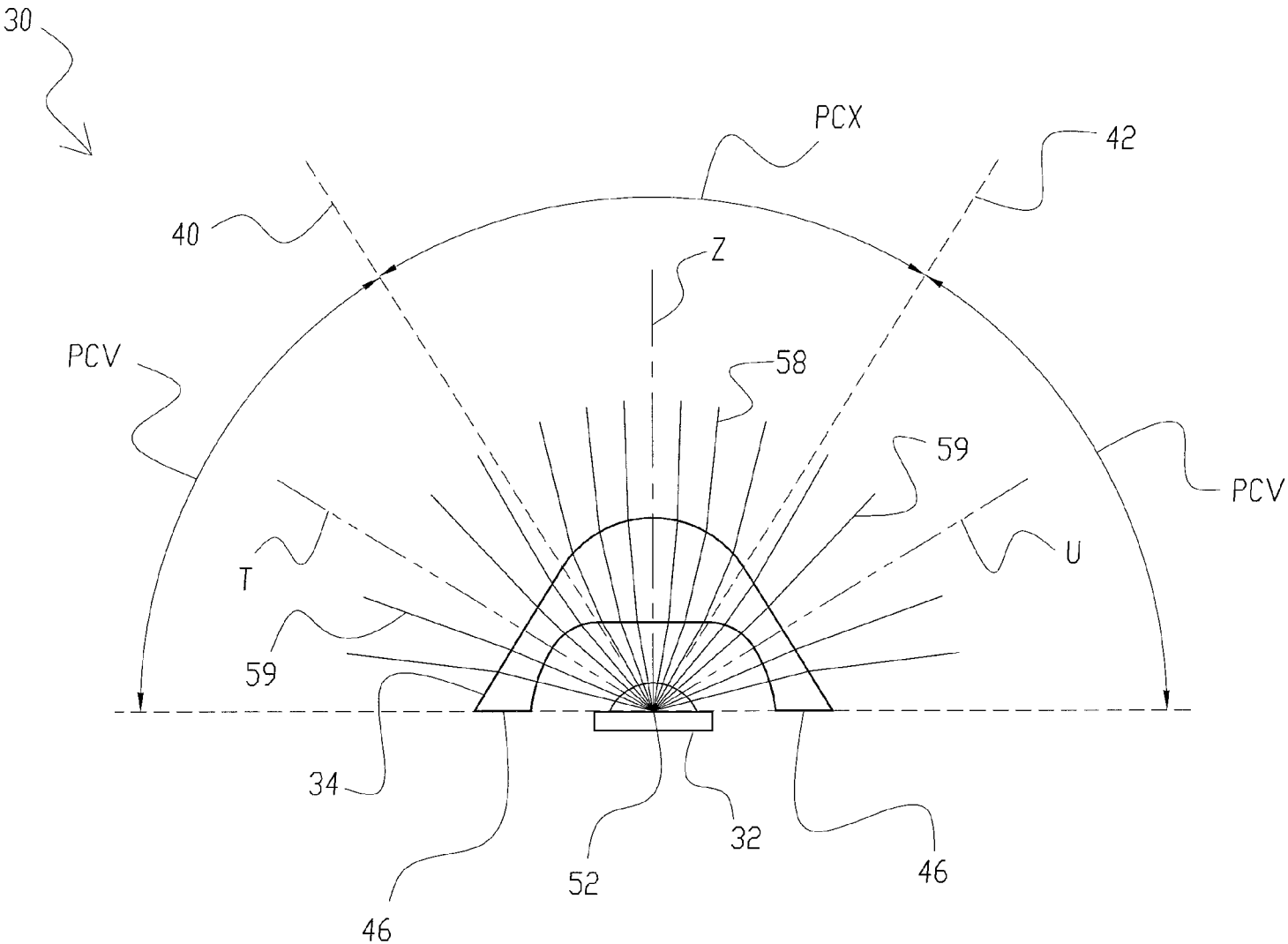
FIG. 7 is an optical ray diagram, illustrating the manner in which the light rays from the LED light source are transmitted and dispersed or scattered in relation to the primary optical axis of the LED light flux source.

An LED light source 30 is shown in FIG. 7 illustrates the manner in which light beams from the LED light clusters are modified by the lens 34 of the type shown in FIG. 6. The light source, as shown, includes a primary optical Axis Z and secondary optical axes T and U. The primary optical axis Z substantially extends through the center of the plano-convex lens PCX while the secondary optical axes T and U substantially extend through the centers of the plano-concave regions or portions of the lens PCV. The light that emanates from the LEDs generally radiate with substantial uniform intensity within the angular boundaries defined by the secondary optical axes T and U. However, the plano-concave regions PCV diffuse or cause the light beams 59 extending therethrough to somewhat diverge because the regions PCV generally have the properties of a negative lens, while the light beams 58 extending through the plano-convex lens region PCX are caused to converge since the plano-convex lens portion PCX serves as a positive lens.

The light source 30 is mounted along the reflector portion 16*d*, as shown in FIG. 8, which illustrates the manner in which desired properties are attained for the CYC luminaire. When the reflector 16 is formed of two portions extending along the housing axis A, the first portion 16*a* preferably extends in the direction of the proximate or near end of a surface to be illuminated, while the second portion 16*b* extends in the direction of the remote or far end of the surface to be illuminated. The light flux source 30 is mounted along the first planar portion of the reflector 16*a* in such a manner as to orient the primary optical axis Z of the light source 30 in the direction of the remote or far end and one of the secondary optical axes U in the direction of the proximate or near end. As noted, the first reflective portion 16*d* is generally flat and the light flux source 30 is mounted along the reflective portion 16*d* such that flux direction of the primary optical axis Z is away from the first reflective portion 16*d*. The second reflective portion 16*e* is arranged to reflect a portion of the light emitted from the LED light source 30 between the primary axis Z and at least one secondary optical axes T in the direction of the remote or far end of the surface to be illuminated. The first reflector portion 16*d* is arranged in relation to the light flux source 30 to reflect minimal light flux from the light flux source, as shown in FIG. 8.

In accordance with the presently preferred embodiment, the distribution of light emanating from the reflector 16 is such that the light flux 60 will be greater in the general direction of the Primary optical axis Z, and lesser in the general direction of the secondary optical axis U.

As suggested, the Reflector surface 16*d*, 16*e*, as well as the inside and outside lens surfaces, 38, 44 are preferably randomly textured to diffuse the light, which helps to integrate the multiple colored light beams emanating from the RGBA LEDs or LED clusters, and provide a smooth transition 61 from lower flux density areas 60*b* to higher flux density areas 60*a* and eliminates "blotchiness" (unwanted projected patterns) on the wall.

The reflector 16 is preferably mounted on a surface of the LED emitter array 32 PCB assembly 36 with an electrically insulating pad 62 between the reflector 16 and the PCB 36, such that the surface 16*d* of the reflector is directly in contact with the rear surface of the lens. This maximizes the amount of collected light from the emitters.

The Cyclorama luminaire in accordance with the present invention is currently available from Altman Stage Lighting Company, Inc., of Yonkers, N.Y., the assignee of the subject application, under its catalogue No. SS-CYC-100, which is a wall wash luminaire utilizing red, green, blue and amber LED emitters. Designed for theatrical and architectural applications, the CYC light blends colors in a manner that reduces pixelization from direct view. The unit may be designed for use on six foot centers, while individual units can be linked side-by-side for greater saturation of light. The Altman unit is compatible with DMX and RDM protocols and may be preprogrammed with single colors to various color mixes. The units can be oriented in any desired positions to be used for floor or sky-CYC applications.

While the invention has been described in detail with particular reference to preferred embodiments thereof, it will be understood that variations and modifications will be effected within the spirit and scope of the invention as described herein and as defined in the appended claims.

The invention claimed is:

1. A cyclorama light comprising a generally enclosed housing forming an interior compartment having a normally horizontal housing axis and an open front defining a window generally arranged within a plane parallel to said axis; reflector substantially covering said window, said reflector having an operative portion that has a substantially uniform cross-section along said housing axis; an LED light emitter array extending along a line substantially parallel to said housing axis, said reflector having a surface configuration and said LED array being arranged in relation to said reflector surface to provide a higher flux density directed toward a far end of a wall or surface to be illuminated and provide a lower flux density directed toward a direction of the near end of the surface to be illuminated, and providing a transition flux density between said far and near ends of the surface to be illuminated; and means for eliminating shadows in the projected light over the entire illuminated surface.

2. A cyclorama light as defined in claim 1, wherein said LED light emitter array comprises RGBA clusters of LEDs.

3. A cyclorama light as defined in claim 1, further comprising control means for selectively energizing individual LEDs in each cluster to create a predetermined color density of the flux being projected.

4. A cyclorama light as defined in claim 1, wherein said clusters comprise high power LEDs.

5. A cyclorama light as defined in claim 1, further comprising a lens positioned between said LED clusters and said reflector.

6. A cyclorama light as defined in claim 5, wherein said lens is in close proximity and encloses said LED clusters.

7. A cyclorama light as defined in claim 5, wherein said lens is made of clear polycarbonate plastic material.

8. A cyclorama light as defined in claim 7, wherein said plastic material is Lexan 945A.

9. A cyclorama light as defined in claim 5, wherein said lens has a uniform cross-section along said axis in the form of a cylindrical deep meniscus.

10. A cyclorama light as defined in claim 5, wherein said lens has a uniform cross-section along said axis in the form of an acylindrical deep meniscus.

11. A cyclorama light as defined in claim 5, wherein said lens has a substantially uniform symmetrical cross-section along said axis.

12. A cyclorama light as defined in claim 5, wherein said lens has an asymmetrical cross-section along said axis.

13. A cyclorama light as defined in claim 5, wherein said lens has both planar and curved surfaces along at least on one of said exterior or interior surfaces of said lens.

14. A cyclorama light as defined in claim 13, wherein said lens surfaces include at least one of convex and concave surfaces.

15. A cyclorama light as defined in claim 5, wherein said lens surrounds said LED array for at least 90° from an optical axis of said LED array.

16. A cyclorama light as defined in claim 5, wherein said lens is randomly textured on at least one of an interior surface facing said LED array or an exterior surface facing said reflector.

17. A cyclorama light as defined in claim 1, wherein said LED array is arranged and oriented to provide a Lambertian flux density distribution.

18. A cyclorama light as defined in claim 1, wherein said LED light emitter array is formed of high power LEDs that can dissipate at least 1 watt of energy.

19. A cyclorama light as defined in claim 18, wherein said LED light emitter array is mounted on a printed circuit board (PCB), and said reflector is mounted on a surface of the LED PCB with an electrically insulting pad between said reflector and said PCB, and a surface of said reflector is directly in contact with a surface of said lens to maximize the amount of collected light from said LED emitters.

20. A cyclorama light as defined in claim 1, wherein said reflector is provided on a surface facing said lens with a pseudo-randomly textured sheet material.

21. A cyclorama light as defined in claim 20, wherein said sheet material is aluminum.

22. A cyclorama light as defined in claim 21, wherein said aluminum is Alanod 9040GP.

23. A cyclorama light as defined in claim 2, wherein said means for eliminating shadows comprises randomly textured surfaces on at least said lens or reflector surfaces, whereby multi-colored shadows are minimized.

24. A cyclorama light comprising a generally enclosed housing forming an interior compartment and having normally horizontal housing axis and an open front defining a window generally arranged within a plane parallel to said axis; a reflector substantially covering said window, said reflector having an operative portion that has a substantially uniform cross-section along said housing axis, and an LED light emitter array extending along a line substantially parallel to said housing, said operative portion of said reflector having a substantially uniform cross-section along the direction of said axis and having an exterior surface facing said LED array and away from said interior compartment, said exterior surface defining a primary optical axis in relation to said LED array to reflect light from said LED array and provide a higher flux density directed toward a far or upper end of a wall or surface to be illuminated and a secondary optical axis in relation to said LED array to reflect light from said LED array and provide a lower flux density directed toward a near or lower end of a wall or surface to be illuminated, a transition flux density being provided between said far and near ends of the wall or surface to be illuminated.

25. A cyclorama light for illuminating a surface having a near or proximate end and a remote or far end relative to a position of the cyclorama light and comprising a generally enclosed housing forming an interior compartment and a housing axis parallel to said surface uniformly spaced from said near and far ends and an open front defining a window generally arranged within a plane parallel to said housing axis; a reflector substantially covering said window, said reflector having an operative portion that has a substantially uniform cross-section along said housing axis, an LED light emitter array extending along a line substantially parallel to said housing axis, said operative portion of said reflector having a substantially uniform cross-section along the direction of said axis and having an exterior surface facing said LED array and away from said interior compartment, and an optical lens between said LED array and said reflector, said LED array and said lens together forming a generally symmetrical light flux source having a central primary optical axis and two secondary optical axis each angularly offset from said primary optical axis; said light flux source being arranged in relation to said operation portion of said reflector to reflect light from light flux source a higher flux density directed toward the far or remote end of the surface to be illuminated and reflect light from said light flux source a lower flux density directed toward the near or proximate end of the surface to be illuminated, a transition flux density being provided between said far and near ends of the surface to be illuminated.

26. A cyclorama light as defined in claim 25, wherein said LED light emitter array comprises RGBA clusters of LEDs.

27. A cyclorama light as defined in claim 25, further comprising control means for selectively energizing individual LEDs in each cluster to create a predetermined color density of the flux being projected.

28. A cyclorama light as defined in claim 25, wherein said clusters comprise high power LEDs.

29. A cyclorama light as defined in claim 25, wherein said lens is in close proximity and encloses said LED clusters.

30. A cyclorama light as defined in claim 25, wherein said lens is made of clear polycarbonate plastic material.

31. A cyclorama light as defined in claim 25, wherein said lens has a uniform cross-section along said housing axis in the form of a cylindrical deep meniscus.

32. A cyclorama light as defined in claim 25, wherein said lens has a uniform cross-section along said housing axis in the form of an acylindrical deep meniscus.

33. A cyclorama light as defined in claim 25, wherein said lens has a substantially uniform symmetrical cross-section along said housing axis.

34. A cyclorama light as defined in claim 25, wherein said lens has an asymmetrical cross-section along said housing axis.

35. A cyclorama light as defined in claim 25, wherein said lens has both planar and curved surfaces along at least on one of said exterior or interior surfaces of said lens.

36. A cyclorama light as defined in claim 35, wherein said lens surfaces include at least one of convex and concave surfaces.

37. A cyclorama light as defined in claim 25, wherein said lens surrounds said LED array for at least 90° from an optical axis of said LED array.

38. A cyclorama light as defined in claim 25, wherein said lens is randomly textured on at least one of an interior surface facing said LED array or an exterior surface facing said reflector.

39. A cyclorama light as defined in claim 25, wherein said LED array is arranged and oriented to provide a Lambertian flux density distribution.

40. A cyclorama light as defined in claim 25, wherein said LED light emitter array is formed of high power LEDs that can dissipate at least 1 watt of energy.

41. A cyclorama light as defined in claim 40, wherein said LED light emitter array is mounted on a printed circuit board (PCB), and said reflector is mounted on a surface of the LED PCB with an electrically insulting pad between said reflector and said PCB, and a surface of said reflector is directly in contact with a surface of said lens to maximize the amount of collected light from said LED emitters.

42. A cyclorama light as defined in claim 25, wherein said reflector is provided on a surface facing said lens with a pseudo-randomly textured sheet material.

43. A cyclorama light as defined in claim 42, wherein said sheet material is aluminum.

44. A cyclorama light as defined in claim 43, wherein said aluminum is Alanod 9040GP.

45. A cyclorama light as defined in claim 25, further comprising means for eliminating shadows comprises randomly textured surfaces on at least said lens or reflector surfaces, whereby multi-colored shadows are minimized.

46. A cyclorama light as defined in claim 25, wherein said light flux source exhibits positive lens areas along said primary optical axis and negative lens areas along said secondary optical axis.

47. A cyclorama light as defined in claim 25, wherein said reflector is formed of two planar portions extending along said housing axis, a first portion in the direction of said proximate or near end of said surface and a second portion in the direction of said remote or far end of said surface, said light flux source being mounted on said first portion to orient said primary optical axis in the direction of said remote or far end and one of said secondary optical axis in the direction of said proximate or near end.

48. A cyclorama light as defined in claim 47, wherein said first reflector portion is generally flat and said light flux source is mounted on said first reflector portion to emit light flux in a direction of said primary optical axis away from said first reflector portion.

49. A cyclorama light as defined in claim 48, wherein said second reflector portion is arranged to reflect light emitted from said light flux source along said primary and at least one secondary optical axis primarily at said remote or far end of said surface.

50. A cyclorama light as defined in claim 48, wherein said first reflector is arranged in relation to said light flux source to reflect minimal light flux from said light flux source.

* * * * *

UNITED STATES PATENT AND TRADEMARK OFFICE

CERTIFICATE OF CORRECTION

PATENT NO. : 8,152,332 B2
APPLICATION NO. : 12/267173
DATED : April 10, 2012
INVENTOR(S) : Ryan It is certified that error appears in the above-identified patent and that said Letters Patent is hereby corrected as shown below:

Column 7, claim 1, lines 34-35 “reflector substantially covering said window” should read “reflector substantially juxtaposed in relation to said window”.

Column 8, claim 19, line 32 “PCB with an electrically insulting pad between said reflector” should read “PCB with an electrically insulating pad between said reflector”.

Column 8, claim 23, line 45 “surfaces on at least said lens or reflector surfaces” should read “surfaces on at least one of said lens and reflector surfaces”.

Column 8, claim 24, line 51 “a reflector substantially covering said window” should read “a reflector substantially juxtaposed in relation to said window”.

Column 9, claim 25, line 8 “a reflector substantially covering said window” should read “a reflector substantially juxtaposed in relation to said window”.

Column 9, claim 25, line 19 “and two secondary optical axis each angularly offset from” should read “and two secondary optical axes each angularly offset from”.

Signed and Sealed this
Twenty-ninth Day of May, 2012

David J. Kappos

David J. Kappos
*Director of the United States Patent and Trademark Office*